US005632044A

United States Patent [19]

Sloot

[11] Patent Number: 5,632,044

[45] Date of Patent: May 27, 1997

[54] VEST WITH INTERCHANGEABLE MESSAGES

[75] Inventor: Alexander Sloot, Sugarloaf, Pa.

[73] Assignee: Printmark Industries, Inc., Hazleton, Pa.

[21] Appl. No.: 443,489

[22] Filed: May 18, 1995

[51] Int. Cl.[6] ..... A41D 1/04

[52] U.S. Cl. ..... 2/102; 40/586

[58] Field of Search ..... 2/102, 115, 108, 2/69, 244, 246, 85, 93, 94, 247, 250; 40/586, 299, 1.5, 1.6

[56] References Cited

U.S. PATENT DOCUMENTS

| | | | |
|---|---|---|---|
| D. 273,818 | 5/1984 | Spencer . | |
| D. 280,860 | 10/1985 | Monferrato . | |
| 2,589,409 | 3/1952 | Leichter | 40/586 |
| 2,767,403 | 10/1956 | Givens . | |
| 2,986,743 | 6/1961 | Eilen | 40/586 |
| 3,047,875 | 8/1962 | Patterson, Jr. . | |
| 3,055,133 | 9/1962 | Anderson | 40/586 |
| 3,561,394 | 2/1971 | Pickens . | |
| 3,582,993 | 6/1971 | Keller | 40/586 |
| 3,727,236 | 4/1973 | Lloyd et al. . | |
| 3,793,644 | 2/1974 | Kellner . | |
| 4,625,337 | 12/1986 | Zahn | 40/586 |
| 4,829,602 | 5/1989 | Harreld et al. . | |
| 4,875,237 | 10/1989 | Cohen | 40/586 |
| 4,912,780 | 4/1990 | Falack . | |
| 4,924,613 | 5/1990 | Levin | 40/586 |
| 4,951,318 | 8/1990 | Harreld et al. . | |

FOREIGN PATENT DOCUMENTS

| | | | |
|---|---|---|---|
| 2625826 | 7/1989 | France | 40/586 |

*Primary Examiner*—C. D. Crowder
*Assistant Examiner*—Gloria Hale
*Attorney, Agent, or Firm*—St. Onge Steward Johnston & Reens LLC

[57] ABSTRACT

A safety vest having a transparent, waterproof pouch preferably formed from thermoplastic material in which a plurality of distress or other messages may be displayed; and which has a side opening through which the messages may be inserted and removed. The pouch is preferably formed from two independent, transparent, and waterproof layers of thermoplastic material, thereby creating a transparent, waterproof pouch to both display and store the message boards which are preferably formed of heavy paper. The layers of the pouch are contiguously sealed along a top, side and bottom edge, and partially up a second side edge, forming a pouch with a side opening and a stop to prevent the boards from sliding out.

2 Claims, 2 Drawing Sheets

VEST WITH INTERCHANGEABLE MESSAGES

FIELD OF THE INVENTION

The invention relates to apparel and more particularly to temporary vests worn to increase the visibility of a person for the purposes of safety or to otherwise signal others.

BACKGROUND OF THE INVENTION

It is often desirable to increase the visibility of one's self over and above that which is obtained from ordinary clothing and ambient light, as well as to otherwise signal others. Examples of these types of situations include pedestrians along hazardous roadways and individuals in crowded areas.

One way of increasing visibility or signaling others is with the use of a vest which may include day-glow or reflective materials. An example of such a device is the safety vest disclosed in U.S. Pat. No. 3,047,785 to Patterson. This prior art vest is comprised of a single, flat, rectangular sheet of flexible luminescent material having a hole for a person's head, and straps to tie the front to the back. While this prior art design may effectively increase the visibility of or draw attention to the wearer, it does not provide any ability to signal others or otherwise convey any information as to who the wearer is or what the wearer desires.

An example of a vest design that does signal and convey information is disclosed in Design U.S. Pat. No. 280,860. This prior art design, discloses a vest which includes a message on the front or back panel. This prior art design does have the ability to signal and convey information from or about the wearer, however, the signal or message conveyed is fixed and may not be changed without removing the vest and donning another. This would of course necessitate having and storing more than one vest.

SUMMARY OF THE INVENTION

The vest of the present invention, which overcomes the drawbacks of the prior designs, is suitable for many uses, including but not limited to use in hazardous or crowded situations.

Accordingly, it is an object of this invention to provide a vest which provides enhanced visibility and the ability to convey information.

It is a further object to provide a vest having the above characteristics wherein the information conveyed by the vest may be readily changed.

It is yet another object of the present invention to provide a vest having the above characteristics wherein information is conveyed by message boards displayed in a transparent pouch.

It is still another object of the present invention to provide a vest having the above characteristics wherein the transparent pouch is waterproof.

It is still yet another object of the present invention to provide a vest having the above characteristics wherein the waterproof transparent pouch has an opening to one side through which the message boards may be inserted and removed.

It is also another object of the present invention to provide a vest having the above characteristics wherein a plurality of message boards are provided some of which have preprinted messages and some of which are blank.

It is yet another object of the present invention to provide a vest having the above characteristics wherein a plurality of message boards may be held within the pouch.

With a vest in accordance with the invention, enhanced visibility is obtained while the vest also has the ability to display any one of a plurality of predetermined or custom messages held in a transparent pouch. This is achieved in accordance with one form of the invention by providing a transparent pocket on the front and/or back portions of the vest into which message boards may be inserted. In one form of the invention the message boards are comprised of messages printed in large block letters on construction paper. The front and back surfaces of the message boards may be employed to provide two separate messages per board, and blank message boards may be included for custom messages created by the wearer.

The invention and its particular features and advantages will become more apparent from the following detailed description considered with reference to the accompanying drawings.

DETAILED DESCRIPTION OF THE INVENTION

Figure 1:
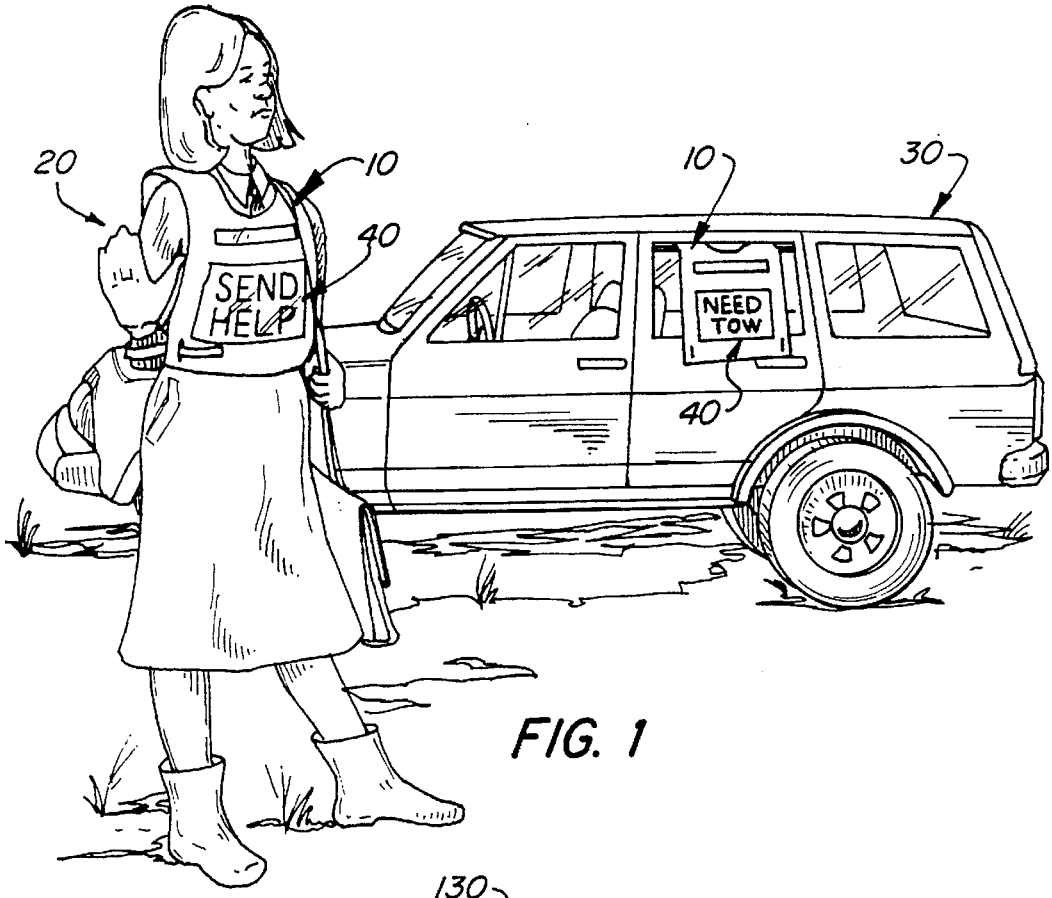
FIG. 1. is a perspective view of the vest of the present invention as worn by a pedestrian and as placed on a stranded vehicle.

Referring to FIG. 1., the vest 10 of the present invention may be placed on the person of a pedestrian 20 or on another object, such as a stranded automobile 30. The vest 10 includes a pouch 40 for displaying messages or other information.

Figure 2:
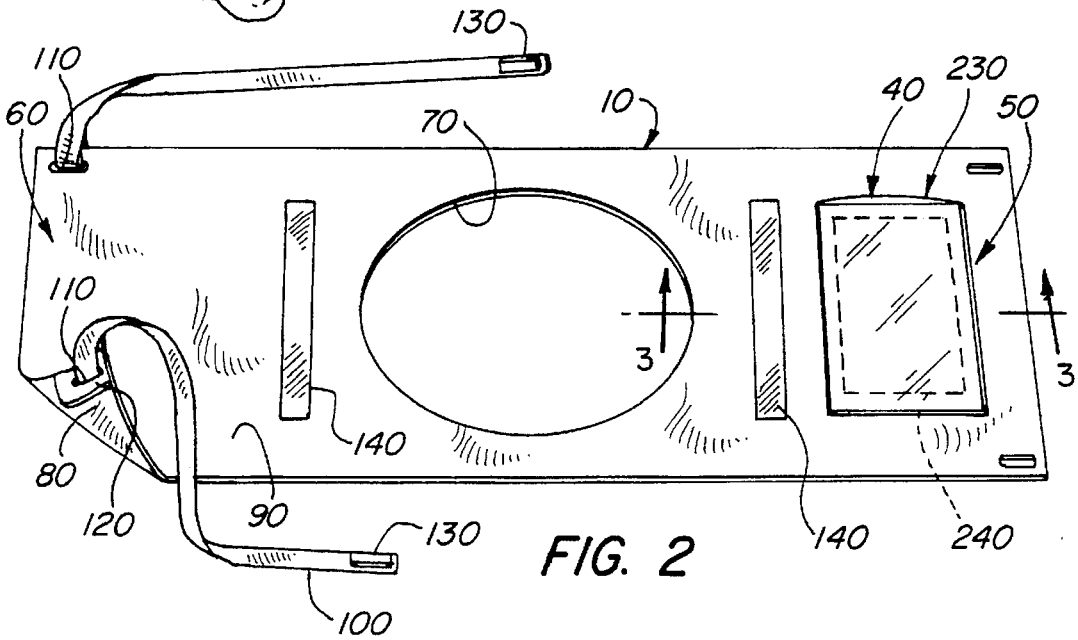
FIG. 2. is a perspective view of the vest of FIG. 1. which has been laid on a flat surface.

Referring to FIG. 2., the vest 10 of the present invention is preferably made of a light weight material, such as TYVEK, a spunbonded olefin material available from the I.E. DuPont Corporation. However, other materials, including but not limited to woven fabric, plastic, or paper, are within the scope of the present invention. Preferably, the material used is relatively inexpensive, lightweight, relatively unaffected by moisture and other environmental conditions, and folds to occupy a small space.

The vest 10 has front and back sections 50, 60 separated by a hole 70 (through which the wearer's head fits), as well as an inside and outside surfaces 80, 90. The pouch 40 may be affixed to either the front or back surface 50, 60, and the vest 10 may include more than one such pouch.

The vest 10 may also include ties 100 looped through tie holes 110 in the vest. The tie holes 110 may include reinforcing patches 120, such as nylon patches, to prevent the ties 100 from tearing the vest 10. The ties 100 may also include fasteners 130, such as VELCRO hook and lop fasteners or self-adhesive fasteners, at their ends to facilitate securing the front and back sections 50, 60 of the vest 10 to one another. The vest 10 may also include reflective strips 140 to enhance night visibility.

Figure 3:
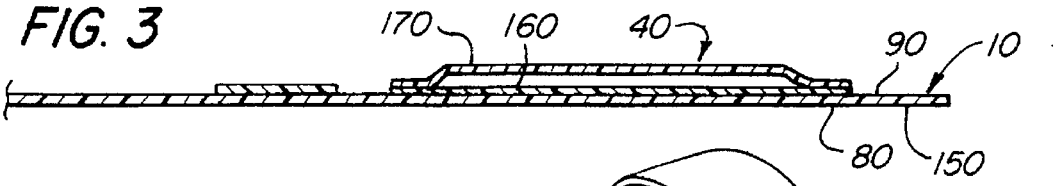
FIG. 3. is a cross-sectional view of the vest of FIG. 1. as seen along the line 3—3 of FIG. 3.

Referring to FIG. 3., the vest 10 of the present invention includes a layer of material 150 having inside and outside surfaces 80, 90. Onto the outside surface 90, a pouch 40 is affixed for the display of messages. Preferably the pouch 40 is formed from inside and outside layers 160, 170 of, preferably, transparent, thermoplastic material. However other materials are within the contemplation of the invention, and additionally, the pouch 40 may formed of only one such layer of material affixed directly to the outside surface 90 of the vest 10. In this case, the vest 10 itself would form the inside layer of the pouch. Alternatively, the pouch 40 may be formed of an opaque inside layer and a transparent outside layer.

In the embodiment wherein the pouch is formed from two independent layers, preferably the inside and outside layers 160, 170 are attached to one another along three edges, namely the top 180, one side 190 and the bottom 200, thereby leaving one open edge 210 for inserting and removing message boards 220. Also, preferably the open edge 210 is partially sealed 230 toward the bottom thereby preventing the message boards 220 from sliding out unintentionally.

The pouch 40 itself, whether comprised of one or more layers, may be affixed to the outside surface 90 of the vest 10 by any appropriate method. Some such methods include gluing, stitching, and heat or RF fusing. It should also be appreciated that the pouch 40 need not be affixed to vest 10 over the entire surface of the inside layer 160. Moreover, the vest 10, could include a hole in the vest material 240 underneath the pouch 40, to permit the pouch 40 to be viewed from either side, thereby making the vest 10 reversible.

Figure 4:
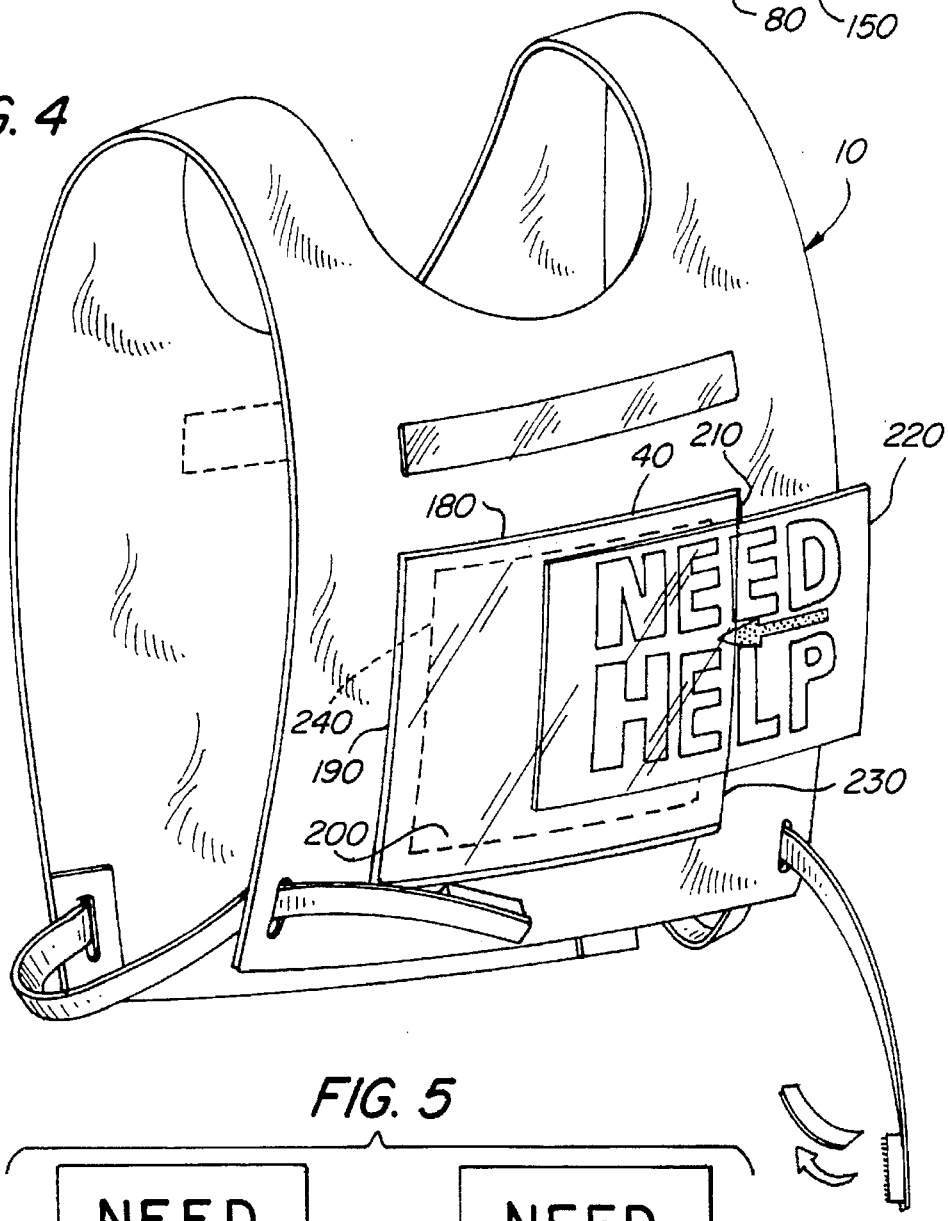
FIG. 4. is a perspective view of the vest of FIG. 1. showing the interchange of a message board.

Referring to FIG. 4., preferably the entire pouch 40 is transparent, thereby providing full view of any messages board 220 displayed therein, however, it should be appreciated that this is not a necessary limitation to the present invention. That is, the inside layer 160 (if any), which would be affixed to the vest 10, need not be transparent, and only a portion of the outside layer 170 need be transparent to be within the spirit of the invention.

Moreover, it should be appreciated that, in some embodiments, the outside layer 170 need not be transparent provided there is a hole through which the message board 220 may be seen. In this embodiment, the outside layer 170 would form a boarder or frame which would hold the message board 220 in place while allowing a central portion to be seen.

While there exist many embodiment of the present invention, as mentioned above, preferably the pouch 40 if formed of two independent inside and outside layers 160, 170 which are comprised of waterproof, transparent thermoplastic material which have been fused to one another along three edges thereby forming a transparent, waterproof pouch 40 for the message boards 220.

Figure 5:
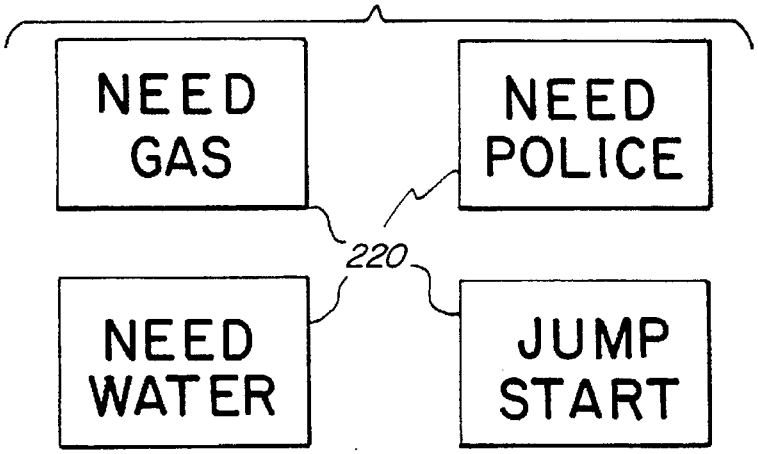
FIG. 5. comprises sample message boards for use in the vest of FIG. 1.

Referring to FIG. 5, multiple, pre-printed message boards 220 may be included to provide the ability to quickly and easily display any one of a number of desired messages. Also, preferably, a plurality of message boards 220 may be stored within the pouch 40 thereby facilitating such interchangeability. Preferably, the message boards 220 are made of relatively rigid construction paper and are slightly smaller in dimension than the inside of the pouch 40.

What is claimed is:

1. A signaling vest comprising:

a vest having front and back panels;

a display pouch attached to one of said front and back panels;

a plurality of display boards removably disposed in said pouch, said boards being visible therethrough; and said pouch being comprised of two layers of transparent thermoplastic material contiguously sealed along a top, bottom and first side edge, said layers also being sealed along a portion of a second side edge, said seal along said second side edge forming a stop to prevent said display boards from sliding along said bottom seal and out of said pouch and forming an opening of said pouch along said second side edge wider than said display boards to allow the insertion of said display boards therethrough.

2. A vest as in claim 1 further comprising:

said front and back panels being comprised of a lightweight material and having a hole;

said front and back panels having reinforced slots located on the bottom corners thereof; and two lightweight straps each attached to one of said slots in said back panel for connecting said back and front panels.

* * * * *